US009927738B2

(12) United States Patent
Koido

(10) Patent No.: US 9,927,738 B2
(45) Date of Patent: Mar. 27, 2018

(54) DEVELOPER STORAGE CONTAINER, DEVELOPING DEVICE, IMAGE FORMING APPARATUS AND SUBSTRATE SUPPORT STRUCTURE

(71) Applicant: Oki Data Corporation, Tokyo (JP)

(72) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/617,042

(22) Filed: Jun. 8, 2017

(65) Prior Publication Data

US 2018/0004122 A1 Jan. 4, 2018

(30) Foreign Application Priority Data

Jun. 29, 2016 (JP) ..... 2016-128303

(51) Int. Cl.
*G03G 21/18* (2006.01)
*G03G 15/08* (2006.01)
*G03G 21/16* (2006.01)

(52) U.S. Cl.
CPC ..... *G03G 15/0865* (2013.01); *G03G 21/1647* (2013.01); *G03G 21/1878* (2013.01)

(58) Field of Classification Search
CPC ..... G03G 21/1647; G03G 21/1882; G03G 21/1885; G03G 21/1878
See application file for complete search history.

(56) References Cited

U.S. PATENT DOCUMENTS

| | | | | |
|---|---|---|---|---|
| 9,291,994 | B2 * | 3/2016 | Kanno | G03G 21/1878 |
| 9,329,569 | B2 * | 5/2016 | Tani | G03G 21/18 |
| 9,513,575 | B2 * | 12/2016 | Kimura | G03G 21/1885 |
| 2008/0003014 | A1 | 1/2008 | Martin et al. | |
| 2015/0037050 | A1 | 2/2015 | Kimura et al. | |

FOREIGN PATENT DOCUMENTS

JP 2012-230237 A 11/2012

* cited by examiner

*Primary Examiner* — Gregory H Curran
(74) *Attorney, Agent, or Firm* — Rabin & Berdo, P.C.

(57) ABSTRACT

A developer storage container includes a container wall, a substrate member having first and second surfaces, and a storage portion provided on the container wall and storing the substrate member. The storage portion includes an outer surrounding wall provided on the container wall, a first support portion disposed inside the outer surrounding wall and supporting the first surface of the substrate member, and a second support portion disposed inside the outer surrounding wall and connected to the container wall. The second support portion supports the first surface of the substrate member. A lid portion is fixed to the outer surrounding wall and has an opening through which the substrate member is exposed. The lid portion contacts the second surface of the substrate member. The lid portion includes first and second protrusions protruding in a second direction perpendicular to a first direction from the substrate member to the container wall. A distance between the first and second protrusions in the second direction is shorter than a length of the substrate member in the second direction. The outer surrounding wall has a through-hole disposed so as to face the second support portion.

16 Claims, 10 Drawing Sheets

DEVELOPER STORAGE CONTAINER, DEVELOPING DEVICE, IMAGE FORMING APPARATUS AND SUBSTRATE SUPPORT STRUCTURE

BACKGROUND OF THE INVENTION

The present invention relates to a developer storage container, a developing device, an image forming apparatus, and a substrate support structure.

A conventional image forming apparatus includes an image drum unit to which a substrate member (i.e., a data carrier) is mounted. The image drum unit has a first engaging portion and a second engaging portion forming a tag storage portion into which the substrate member is inserted (see, for example, Japanese Patent Application Publication number 2012-230237).

However, when the used and recovered image drum unit is classified, it is difficult to remove the substrate member from the tag storage portion, and therefore classification work takes time.

SUMMARY OF THE INVENTION

The present invention is intended to provide a developer storage container, a developing device, an image forming apparatus and a substrate support structure capable of simplifying classification work.

According to an aspect of the present invention, there is provided a developer storage container including a container wall, a substrate member having a first surface and a second surface opposite to each other, and a storage portion provided on the container wall and storing the substrate member. The storage portion includes an outer surrounding wall provided on the container wall, a first support portion disposed inside the outer surrounding wall and supporting the first surface of the substrate member, and a second support portion disposed inside the outer surrounding wall and connected to the container wall. The second support portion supports the first surface of the substrate member. The storage portion further includes a lid portion fixed to the outer surrounding wall and having an opening through which the substrate member is exposed. The lid portion contacts the second surface of the substrate member. The lid portion includes a first protrusion and a second protrusion protruding in a second direction perpendicular to a first direction from the substrate member to the container wall. A distance between the first protrusion and the second protrusion in the second direction is shorter than a length of the substrate member in the second direction. The outer surrounding wall has a through-hole disposed so as to face the second support portion.

With such a configuration, classification work of the used developer storage container can be simplified.

According to another aspect of the present invention, there is provided a developing device including the developer storage container, and a developer bearing body that develops a latent image on an image bearing body using a developer supplied by the developer storage container.

According to still another aspect of the present invention, there is provided an image forming apparatus including an image bearing body, a latent image forming device that forms a latent image on the image bearing body, the developer storage container, and a developer bearing body that develops the latent image on the image bearing body using the developer supplied by the developer storage container.

According to yet another aspect of the present invention, there is provided a substrate support structure including a substrate member having a first surface and a second surface opposite to each other, and a storage portion storing the substrate member. The storage portion includes a bottom portion, an outer surrounding wall provided on the bottom portion and surrounding an outer circumference of the substrate member, a first support portion disposed inside the outer surrounding wall and supporting the first surface of the substrate member, a second support portion disposed inside the outer surrounding wall and supporting the first surface of the substrate member, and a lid portion fixed to the outer surrounding wall and having an opening through which the substrate member is exposed. The lid portion contacts the second surface of the substrate member. The lid portion includes a first protrusion and a second protrusion protruding in a second direction perpendicular to a first direction from the substrate member to the container wall. A distance between the first protrusion and the second protrusion in the second direction is shorter than a length of the substrate member in the second direction. The outer surrounding wall has a through-hole disposed so as to face the second support portion.

DETAILED DESCRIPTION OF THE PREFERRED EMBODIMENT

Figure 1:
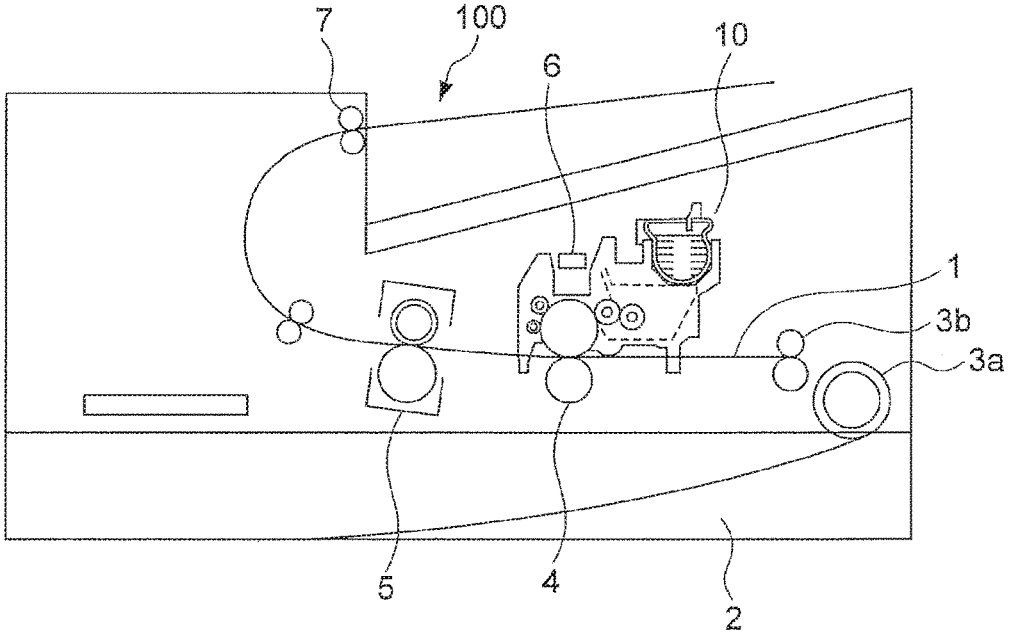
FIG. 1 is a sectional view schematically showing a configuration of a printer as an image forming apparatus including a developer storage container according to Embodiment 1 of the present invention.

Hereinafter, developer storage containers of embodiments of the present invention will be described with reference to the attached drawings. In order to facilitate understanding relationships between the drawings, an xyz orthogonal coordinate system is illustrated in the drawings. The x axis is a coordinate axis parallel to a longitudinal direction of a substrate storage portion. The y axis is a coordinate axis parallel to a widthwise direction of the substrate storage portion. The z axis is a coordinate axis parallel to a height direction of the substrate storage portion.

Embodiment 1

Configuration of Embodiment 1

FIG. 1 is a sectional view schematically showing a configuration of a printer 100 as an image forming apparatus including a developer storage container according to Embodiment 1 of the present invention. The printer 100 is configured as an electrophotographic printer, and is configured to print an image of, for example, black (K). As shown in FIG. 1, the printer 100 of Embodiment 1 includes an image drum unit 10 detachably mounted in a main body of the printer 100, a cassette 2 as a medium storage portion storing recording sheets (media) 1, a hopping roller 3*a* as a medium feeding member, a pair of transport rollers 3*b* as medium transport members, a transfer roller 4 as a transfer member, a fixing unit 5 as a fixing device, an LED (Light Emitting Diode) head 6 as a latent image forming device, and ejection rollers 7 as medium ejection members.

Figure 2:
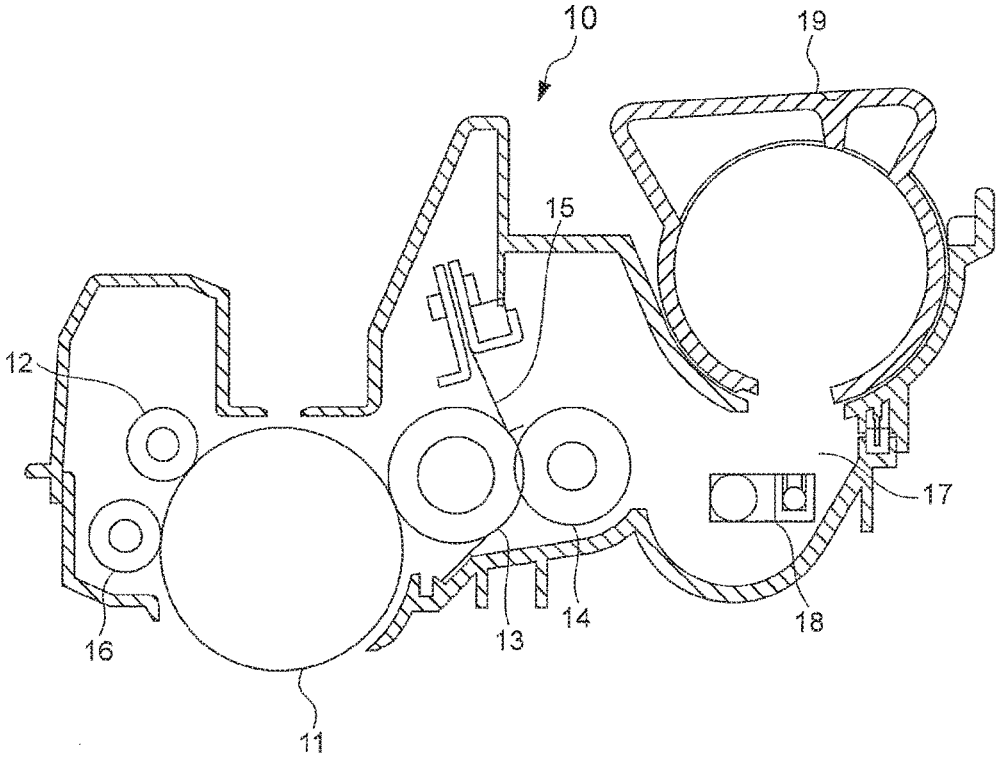
FIG. 2 is a sectional view schematically showing a configuration of an image drum unit of Embodiment 1.

FIG. 2 is a sectional view schematically showing a configuration of the image drum unit 10 of Embodiment 1. As shown in FIG. 2, the image drum unit 10 includes a photosensitive drum 11 as an image bearing body, a charging roller 12, a developing roller 13 as a developing member, a toner supplying roller 14, a developing blade 15, a cleaning roller 16, a toner storage chamber 17, an agitation bar 18, and a toner cartridge 19.

The photosensitive drum 11 (i.e., an image bearing body) is configured to bear an electrostatic latent image and a toner image (i.e., a developer image) thereon. The charging roller 12 (i.e., a charging member) is configured to uniformly charge a surface of the photosensitive drum 11. The charging roller 12 is disposed so as to contact the photosensitive drum 11.

The developing roller 13 (i.e., a developer bearing body) is configured to bear a toner (i.e., a developer) to be supplied to the photosensitive drum 11. The developing roller 13 is disposed so as to contact the photosensitive drum 11. The developing roller 13 bears the toner, and rotates to supply the toner to the photosensitive drum 11. The developing roller 13 develops (visualizes) the electrostatic latent image on the photosensitive drum 11 to form a toner image (i.e., a developer image) by causing the toner to adhere to the surface of the photosensitive drum 11.

The toner supplying roller 14 (i.e., a developer supplying member) is configured to supply the toner to the developing roller 13. The toner supplying roller 14 is disposed so as to contact the developing roller 13. The developing blade 15 (i.e., a developer layer thickness regulation member) is configured to regulate a thickness of a layer of the toner supplied to the developing roller 13. The developing blade 15 is disposed so that a tip (i.e., a bent portion) thereof contacts the developing roller 13.

The cleaning roller 16 (i.e., a developer removing member) is configured to remove the toner remaining on the surface of the photosensitive drum 11 after a transfer process. The toner storage chamber 17 (i.e., a developer storage chamber) is configured to temporarily store the toner to be supplied to the developing roller 13. The agitation bar 18 (i.e., an agitating member) is configured to agitate the toner inside the toner storage chamber 17.

Figure 3:
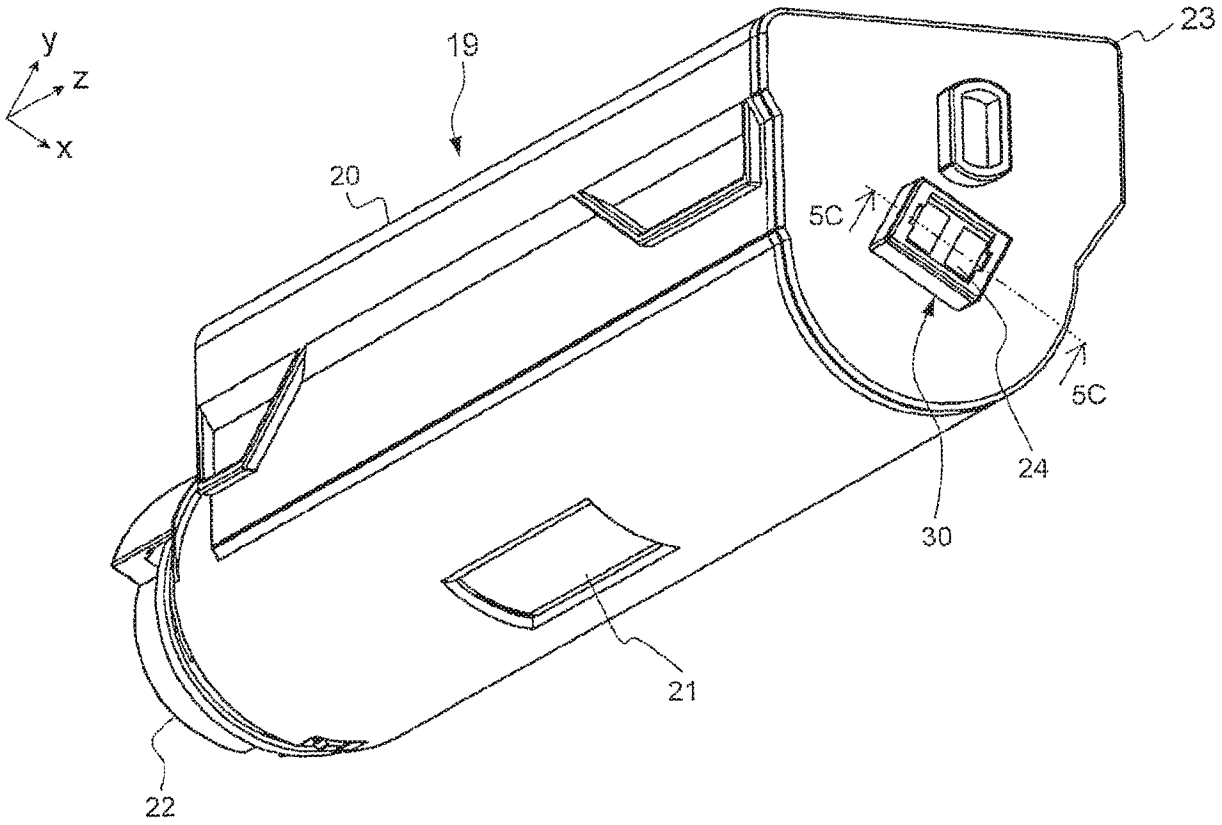
FIG. 3 is a perspective view showing a configuration of a toner cartridge of Embodiment 1.

Further, the image drum unit 10 includes the toner cartridge 19 as an attachable/detachable replaceable unit. The toner cartridge 19 (i.e., a developer storage container) is configured to store the toner used for development. FIG. 3 is a perspective view showing an external configuration of the toner cartridge 19 of Embodiment 1. As shown in FIG. 3, the toner cartridge 19 includes an outer cartridge 20, a toner supply opening 21, a shutter 22, a side cover 23 as a container wall, a substrate member 24, and a substrate storage portion 30 as a storage portion.

As shown in FIG. 3, the outer cartridge 20 is a main body of the toner cartridge 19, and stores the toner therein. The outer cartridge 20 has a bottom portion (i.e., a cylindrical portion) having a cylindrical shape.

As shown in FIG. 3, the toner supply opening 21 is provided on a bottom portion of the toner cartridge 19. The toner supply opening 21 (i.e., a developer supply opening) is provided for supplying the toner from the toner cartridge 19 to the toner storage chamber 17. The toner supply opening 21 is opened and closed by the shutter 22 as an opening-and-closing member.

As shown in FIG. 3, the shutter 22 having a substantially cylindrical shape is rotatably provided, and protrudes through a side of the outer cartridge 20 in a longitudinal direction. When a toner ejection opening formed on a cylindrical wall of the shutter 22 is aligned with the toner supply opening 21, the toner stored in the toner cartridge 19 falls through the toner supply opening 21, and is supplied to the toner storage chamber 17.

As shown in FIG. 3, the side cover 23 is provided on the other side of the outer cartridge 20 (i.e., opposite to the side through which the shutter 22 protrudes) in the longitudinal direction. The side cover 23 is configured to cover a side surface of the outer cartridge 20. The substrate storage portion 30 is formed on the side cover 23, and the substrate member 24 is stored in the substrate storage portion 30.

Figure 4A:
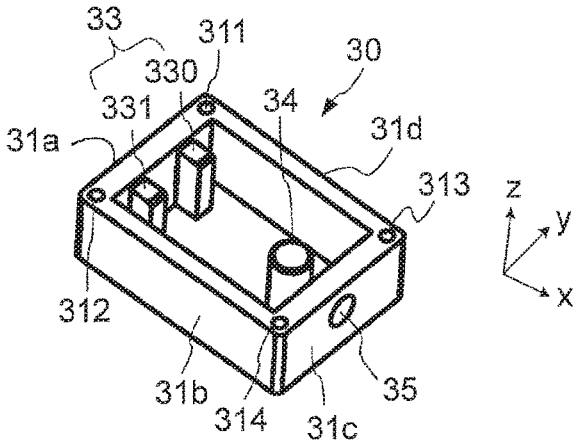
FIG. 4A is a perspective view showing a configuration of a substrate storage portion.

FIGS. 4A through 4D are enlarged perspective views showing configurations of the substrate member 24 and the substrate storage portion 30 of Embodiment 1. FIG. 4A is a perspective view showing a configuration of the substrate storage portion 30. As shown in FIG. 4A through 4D, the substrate storage portion 30 includes an outer surrounding wall 31 surrounding the substrate member 24, a lid portion 32, a first support portion 33 and a second support portion 34. The first support portion 33 and the second support portion 34 are formed on a bottom portion 36 of the substrate storage portion 30, and support the substrate member 24. In this regard, the bottom portion 36 of the substrate storage portion 30 may be formed integrally with the side cover 23 (i.e., the container wall).

As shown in FIG. 4A, the substrate storage portion 30 has a rectangular shape as seen in +z axis direction. A through-hole 35 is formed on a side (i.e., a side 31*c* described later) of the outer surrounding wall 31. A plurality of insertion holes 311, 312, 313 and 314 are formed on four corners of the outer surrounding wall 31. Protrusions 325, 326, 327 and 328 of the lid portion 32 are inserted into the insertion holes 311, 312, 313 and 314. The outer surrounding wall 31 of the substrate storage portion 30 has a side 31*a* (i.e., a first side) and a side 31*c* (i.e., a second side) extending in the widthwise direction, and a side 31*b* (i.e., a third side) and a side 31*d* (i.e., a fourth side) extending in the longitudinal direction. In other words, the sides 31*a* and 31*c* are shorter sides, and the sides 31*b* and 31*d* are longer sides.

As shown in FIG. 4A, the first support portion 33 includes a substrate support stand 330 (i.e., a first substrate support stand) and a substrate support stand 331 (i.e., a second substrate support stand). In an example shown in FIG. 4A, the substrate member 24 is supported by a three-point support structure including the substrate support stand 330 of the first support portion 33, the substrate support stand 331 of the first support portion 33, and the second support portion 34.

Each of the substrate support stands 330 and 331 has, for example, a square column shape (or a rectangular parallelepiped shape). The first support portion 33 is disposed besides (i.e., so as to face), for example, the side 31*a*. As shown in FIG. 4A, the second support portion 34 is disposed beside (i.e., so as to face) the side 31*c* opposite to the side 31*a* beside which the first support portion 33 is disposed. The second support portion 34 has, for example, a circular cylinder shape. Shapes of the substrate support stands 330 and 331 are not limited to those shown in FIG. 4A. For example, each of the substrate support stands 330 and 331 may have a circular cylinder shape. A shape of the second support portion 34 is not limited to that shown in FIG. 4A. The second support portion 34 may have a square column shape.

Figure 4B:
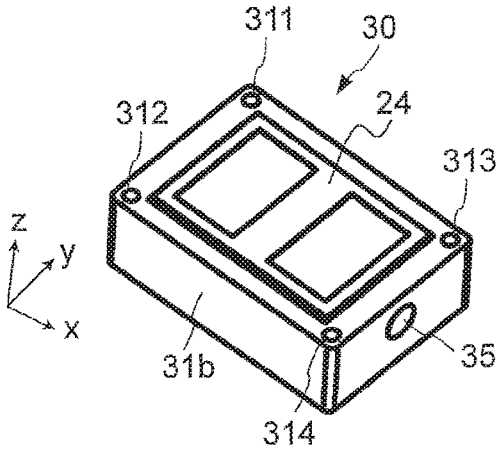
FIG. 4B is a perspective view showing a state where a substrate member is mounted in the substrate storage portion.

FIG. 4B is a perspective view showing a state where the substrate member 24 is mounted in the substrate storage portion 30. As shown in FIG. 4B, the substrate member 24 is placed on top surfaces of the substrate support stands 330 and 331 of the first support portion 33 and the second support portion 34, and is supported by the three-point support structure including the substrate support stands 330 and 331 and the second support portion 34.

Figure 4C:
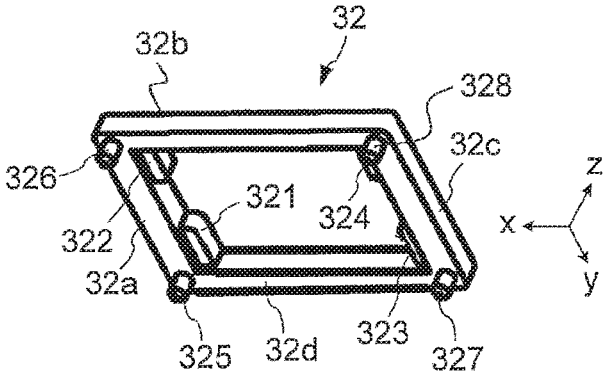
FIG. 4C is a perspective view showing a configuration of a lid portion fixed to the substrate storage portion.

FIG. 4C is a perspective view showing a configuration of the lid portion 32 fixed to a top surface of the substrate storage portion 30. As shown in FIG. 4C, the lid portion 32 has a rectangular shape as seen in +z axis direction. As shown in FIG. 4C, the lid portion 32 includes protrusions 321 and 322 (i.e., first protrusions) provided on a side (i.e., a side 32*a* described later) of the lid portion 32, and protrusions 323 and 324 (i.e., second protrusions) provided on the other side (i.e., a side 32*c* described later) of the lid portion 32. The protrusions 321, 322, 323 and 324 contact the substrate member 24, and restrict a movement of the substrate member 24 in a thickness direction (i.e., +z axis direction).

In this regard, in a state where the lid portion 32 is fixed to the outer surrounding wall 31 of the substrate storage portion 30, the protrusions 321, 322, 323 and 324 do not necessarily contact the substrate member 24. A clearance (i.e., a gap) may be formed between the protrusions 321, 322, 323 and 324 and the substrate member 24. Even when the clearance exists, the substrate member 24 is pressed by a contact pin (not shown) toward the substrate storage portion 30, and is fixed to the substrate storage portion 30. The contact pin is provided on a surface in the printer 100 facing the side surface of the toner cartridge 19 in the longitudinal direction.

Further, as shown in FIG. 4C, the lid portion 32 includes protrusions 325, 326, 327 and 328 as third protrusions. The protrusions 325, 326, 327 and 328 of the lid portion 32 are press-fitted (or welded, bonded or the like) into the insertion holes 311, 312, 313 and 314 of the outer surrounding wall 31, and the lid portion 32 is fixed to the outer surrounding wall 31 of the substrate storage portion 30. The lid portion 32 includes a side 32*a* (i.e., a fifth side) and a side 32*c* (i.e., a sixth side) extending in the widthwise direction, and a side 32*b* (i.e., a seventh side) and a side 32*d* (i.e., an eighth side) extending in the longitudinal direction. In other words, the sides 32*a* and 32*c* are shorter sides, and the sides 32*b* and 32*d* are longer sides.

Figure 4D:
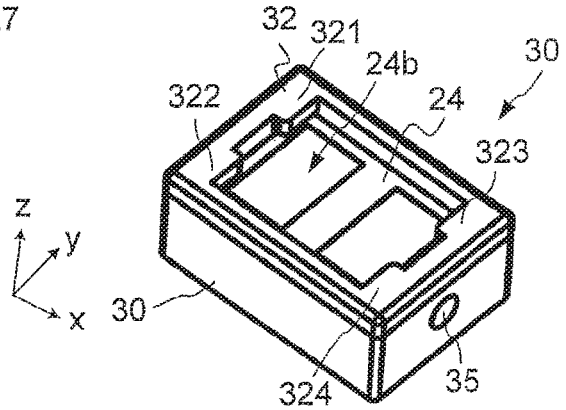
FIG. 4D is a perspective view showing a state where the lid portion is fixed to the substrate storage portion in which the substrate member is mounted.

FIG. 4D is a perspective view showing a state where the lid portion 32 is fixed to the substrate storage portion 30 storing the substrate member 24. As shown in FIG. 4D, the lid portion 32 presses a surface 24*b* (i.e., a second surface) of the substrate member 24 opposite to a surface 24*a* (i.e., a first surface) of the substrate member 24 facing the bottom portion 36 of the substrate storage portion 30. The lid portion 32 presses the surface 24*b* of the substrate member 24 in −z axis direction. In a state where the substrate member 24 is stored in the substrate storage portion 30, the lid portion 32 is fixed to the outer surrounding wall 31 of the substrate storage portion 30 by press-fitting the protrusions 325, 326, 327 and 328 of the lid portion 32 into the insertion holes 311, 312, 313 and 314 of the outer surrounding wall 31.

Figure 5A:
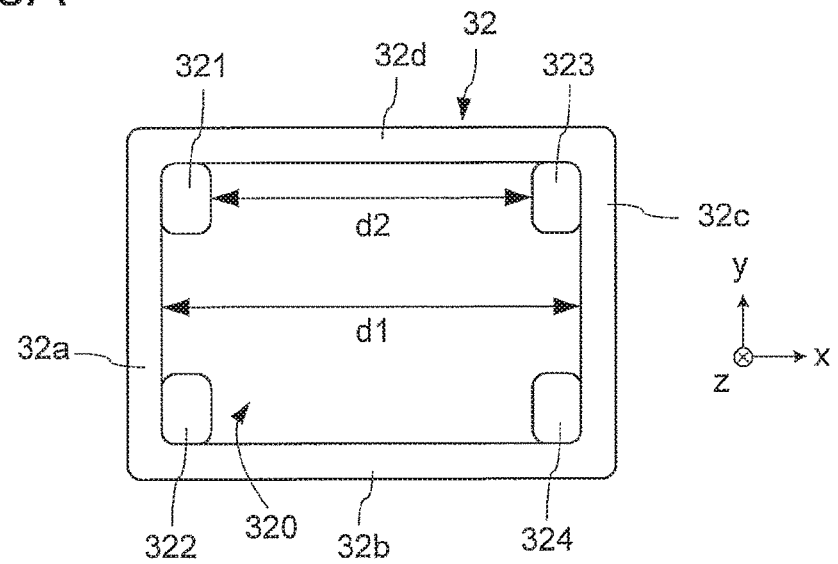
FIG. 5A is a bottom view (i.e., a view as seen in +Z direction) showing a configuration of the lid portion of Embodiment 1.
Figure 5B:
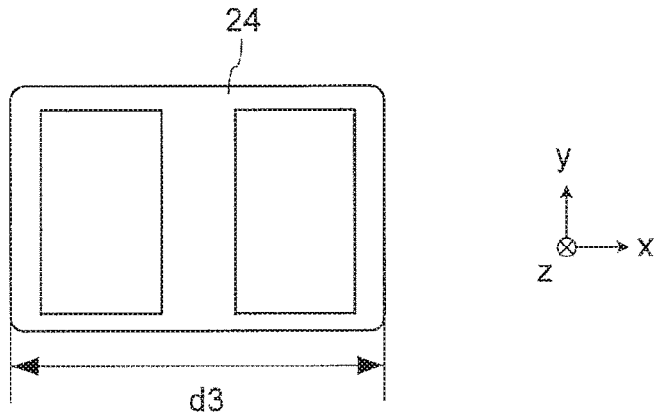
FIG. 5B is a bottom view (i.e., a view as seen in +Z direction) showing a configuration of the substrate member of Embodiment 1.
Figure 5C:
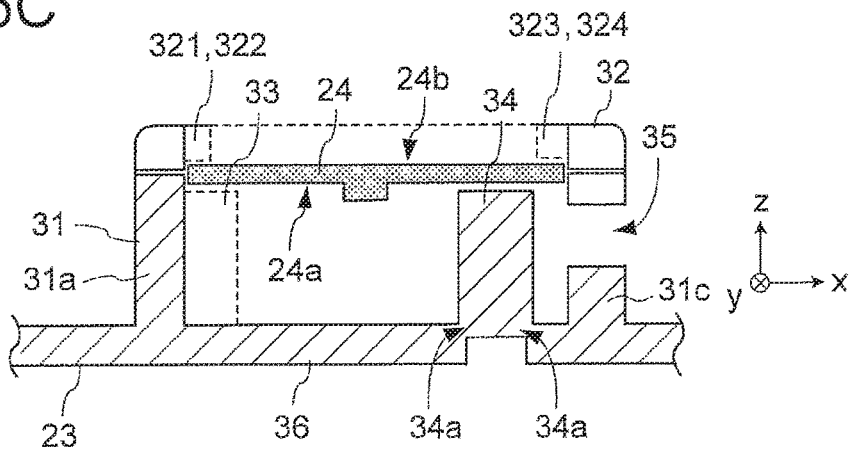
FIG. 5C is a sectional view taken along line 5C-5C in FIG. 3 showing a configuration of the substrate storage portion of Embodiment 1.

FIG. 5A is a bottom view (i.e., a view as seen in +z axis direction) showing a configuration of the lid portion 32 of Embodiment 1. FIG. 5B is a bottom view (i.e., a view as seen in +z axis direction) showing a configuration of the substrate member 24 of Embodiment 1. FIG. 5C is a sectional view taken along line 5C-5C in FIG. 3 showing a configuration of the substrate storage portion 30 of Embodiment 1.

As shown in FIG. 5A, the protrusions 321, 322, 323 and 324 are formed on the sides 32*a* and 32*c* (i.e., the fifth side and the sixth side) of the lid portion 32 facing each other. To be more specific, the protrusions 321 and 322 protrude inwardly (i.e., +x direction) from the side 32*a* of the lid portion 32. The protrusions 323 and 324 protrude inwardly (i.e., −x direction) from the side 32*b* of the lid portion 32. The protrusions 321, 322, 323 and 324 may be formed integrally with the lid portion 32. Alternatively, the protrusions 321, 322, 323 and 324 may be formed as separate members, and fixed to the lid portion 32 using adhesive agent or the like. As shown in FIG. 5A, the lid portion 32 has an opening 320 having a length d1 in the longitudinal direction (i.e., the x axis direction).

As shown in FIG. 5A, a distance between the side 32*a* and the side 32*c* (i.e., two sides of the lid portion 32 facing each other) of the lid portion 32 is the same as the length d1 of the opening 320 of the lid portion 32 in the longitudinal direction. Further, a distance between the protrusion 321 and the protrusion 323 of the lid portion 32 is expressed as d2. Here, the length d1 of the opening 320 of the lid portion 32 in the longitudinal direction is longer than the distance d2 between the protrusion 321 and the protrusion 323 of the lid portion 32. That is, the length d1 and the distance d2 satisfy a relationship: d1>d2.

As shown in FIG. 5B, a length of the substrate member 24 in the longitudinal direction (i.e., the x axis direction) is d3. Here, the length d3 of the substrate member 24 in the longitudinal direction (i.e., the x axis direction) is shorter than the length d1 of the opening 320 of the lid portion 32 in the longitudinal direction, and longer than the distance d2 between the protrusion 321 and the protrusion 323 (i.e., a length between the first protrusion and the second protrusion) of the lid portion 32. That is, the length d1, the distance d2 and the distance d3 satisfy a relationship: d1>d3>d2. With such a relationship (particularly, d3>d2), when the substrate member 24 is stored in the substrate storage portion 30 and is fixed by the lid portion 32, a movement of the substrate member 24 in the thickness direction (i.e., +z axis direction) is restricted by the protrusions 321, 322, 323 and 324 of the lid portion 32. Therefore, the substrate member 24 is prevented from being removed from the substrate storage portion 30.

As shown in FIG. 5C, the second support portion 34 is connected to the bottom portion 36 of the substrate storage portion 30 at a connecting portion 34*a* in the form of a thin-walled portion. As shown in FIG. 5C, the connecting portion 34*a* is made thinner than a portion of the bottom portion 36 around (i.e., adjacent to) the connecting portion 34*a*. Since the second support portion 34 is connected to the bottom portion 36 of the substrate storage portion 30 at the connecting portion 34*a* (i.e., the thin-walled portion), the bottom portion 36 of the substrate storage portion 30 can be easily broken.

Operation of Embodiment 1

First, an operation of the printer 100 having the above described configuration will be described with reference to FIG. 1.

When the printer 100 starts a printing operation, the hopping roller 3*a* rotates to feed the recording sheet 1 out of the cassette 2. The transport rollers 3*b* transport the recording sheet 1 to the image drum unit 10 along a sheet transport path. The image drum unit 10 transfers the toner image to a recording surface of the recording sheet 1. The fixing unit 5 fixes the transferred toner image to the recording sheet 1. The ejection rollers 7 eject the recording sheet 1 with the fixed toner image outside the printer 100.

An operation of the image drum unit 10 in the printing operation will be described with reference to FIG. 2.

In the image drum unit 10, the toner supplying roller 14 supplies the toner (replenished from the toner cartridge 19) to the developing roller 13. The developing blade 15 forms a toner layer having a uniform thickness on the developing roller 13. The LED head 6 forms an electrostatic latent image on the image photosensitive drum 11 according to print data. The electrostatic latent image is developed (visualized) with the toner on the developing roller 13. The toner image on the photosensitive drum 11 is transferred to the recording sheet 1 by the transfer roller 4. After the transfer of the toner image, the toner remaining on the surface of the photosensitive drum 11 is removed by the cleaning roller 16.

Next, a removing operation of the substrate member 24 from the toner cartridge 19 will be described with reference to FIGS. 6A through 6D.

FIGS. 6A through 6D are views for showing the removing operation of the substrate member 24 from the toner cartridge 19 of Embodiment 1. When the used toner cartridges 19 are recovered, the substrate members 24 are removed from the toner cartridges 19, and the toner cartridges 19 are classified. FIGS. 6A through 6D corresponds to sectional views taken along line 5C-5C in FIG. 3.

Figure 6A:
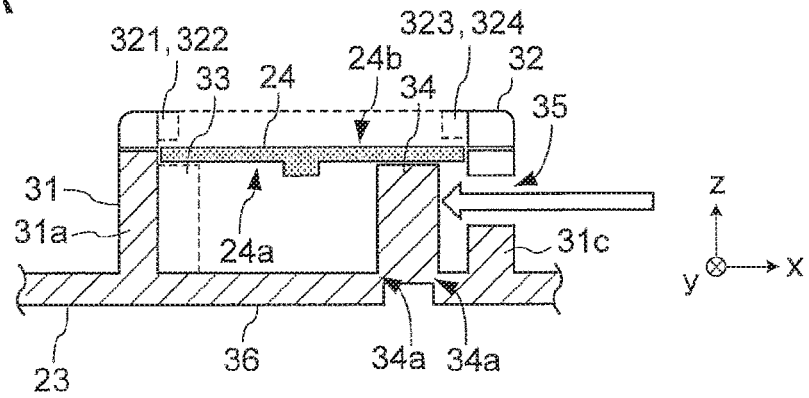
FIGS. 6A, 6B, 6C and 6D are schematic views showing a removing operation of the substrate member from the toner cartridge of Embodiment 1.

In a state shown in FIG. 6A, the protrusion 321, 322, 323 and 324 of the lid portion 32 restrict the substrate member 24 from moving upward (i.e., +z axis direction). In this state, the substrate member 24 cannot be removed from the substrate storage portion 30. As shown in FIG. 6A, the through-hole 35 is formed on the side 31*c* of the outer surrounding wall 31 of the substrate storage portion 30. The through-hole 35 is disposed so as to face the second support portion 34.

In the removing operation of the substrate member 24 from the toner cartridge 19, a tool or the like is inserted through the through-hole 35 of the outer surrounding wall 31 of the substrate storage portion 30 as shown in FIG. 6A. Then, the second support portion 34 is pressed using the tool so as to break the connecting portion 34*a* (i.e., the thin-walled portion). As the connecting portion 34*a* is broken, the second support portion 34 is disconnected from the bottom portion 36 of the substrate storage portion 30.

Figure 6B:
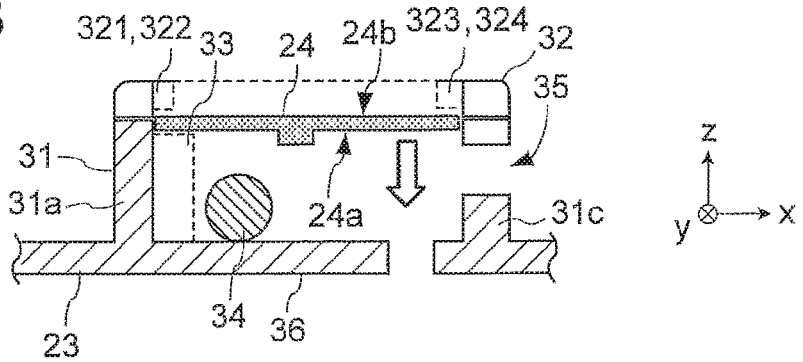
Figure 6C:
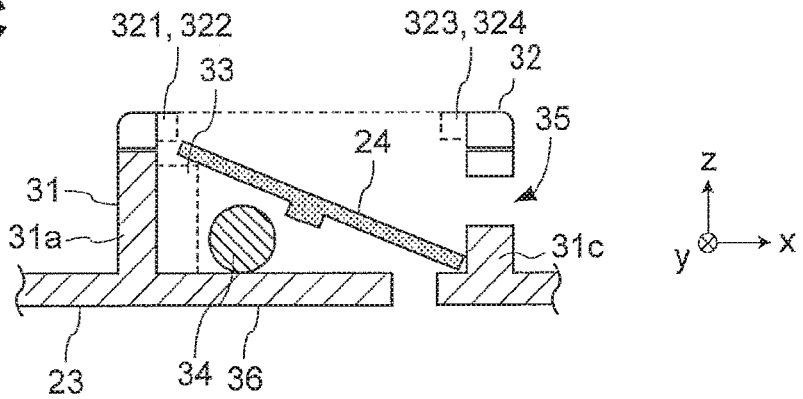

As shown in FIG. 6B, the second support portion 34 falls down on the bottom portion 36 of the substrate storage portion 30, and rolls on the bottom portion 36 toward the side 31*a*. As shown in FIG. 6C, breaking of the second support portion 34 causes one of the three-point support structure supporting the substrate member 24 to be lost. Therefore, one side of the substrate member 24 falls down and contacts the bottom portion 36 of the substrate storage portion 30. In this state, the substrate member 24 is inclined.

Figure 6D:
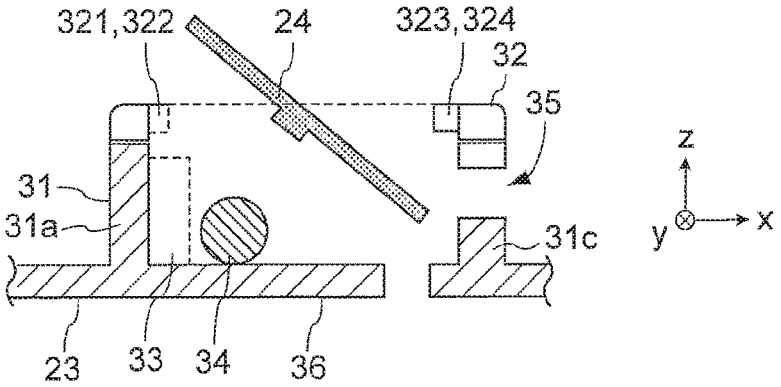

As shown in FIG. 6D, the inclined substrate member 24 is picked out using a tool, a user's hand or the like. In the state shown in FIG. 6D, the substrate member 24 is inclined as the second support portion 34 is broken, and the substrate member 24 can be easily removed from the substrate storage portion 30, without being interfered with the protrusions 321, 322, 323 and 324 of the lid portion 32.

Effect of Embodiment 1

According to the developer storage container (i.e., the toner cartridge 19) of Embodiment 1, the substrate storage portion 30 includes the first support portion 33 and the second support portion 34. The second support portion 34 can be broken by being pressed by the tool or the like inserted through the through-hole 35 of the outer surrounding wall 31 of the substrate storage portion 30. By breaking the second support portion 34, one side of the substrate member 24 falls down on the bottom portion 36 of the substrate storage portion 30, and the substrate member 24 is inclined. Therefore, the substrate member 24 can be easily removed without being interfered with the protrusions 321, 322, 323 and 324 of the lid portion 32 of the substrate storage portion 30. Accordingly, classification work can be effectively performed.

Embodiment 2

FIG. 7A through 7D are perspective views showing a configuration of a substrate storage portion 30*a* of Embodiment 2 of the present invention. FIG. 8A is a bottom view (i.e., a view as seen in +z axis direction) showing a configuration of a lid portion 32*e* of Embodiment 2. FIG. 8B is a bottom view (i.e., a view as seen in +z axis direction) showing a configuration of a substrate member 24 of Embodiment 2. FIG. 8C is a sectional view (corresponding to a sectional view taken along line 5C-5C in FIG. 3) showing a configuration of a substrate storage portion 30*a* of Embodiment 2. FIGS. 9A through 9D are views showing a removing operation of the substrate member 24 from a toner cartridge 19 of Embodiment 2.

In FIGS. 7A through 7D, elements which are the same as or correspond to those shown in FIGS. 4A through 4D are assigned with the same reference numerals as those shown in FIGS. 4A through 4D. In FIGS. 8A through 8D, elements which are the same as or correspond to those shown in FIGS. 5A through 5D are assigned with the same reference numerals as those shown in FIGS. 5A through 5D. In FIGS. 9A through 9D, elements which are the same as or correspond to those shown in FIGS. 6A through 6D are assigned with the same reference numerals as those shown in FIGS. 6A through 6D.

The substrate storage portion 30*a* of Embodiment 2 differs from the substrate storage portion 30 of Embodiment 1 in shape of a second support portion 34*b*. Further, the lid portion 32*e* of Embodiment 2 differs from the lid portion 32 of Embodiment 1 in positions and shapes of protrusions 321*e*, 322*e*, 323*e* and 324*e*. Other configurations are the same as those of Embodiment 1, and descriptions thereof will be omitted.

Figure 7A:
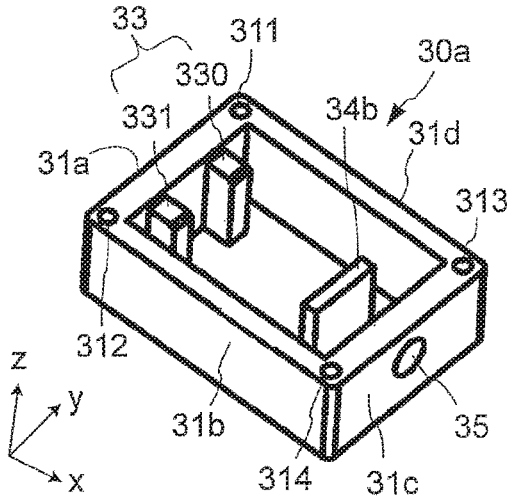
FIGS. 7A, 7B, 7C and 7D are perspective views showing a configuration of a substrate storage portion of Embodiment 2.
Figure 7B:
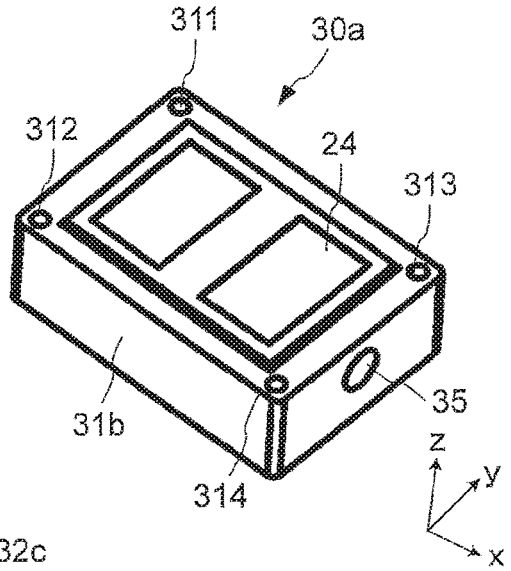
Figure 8A:
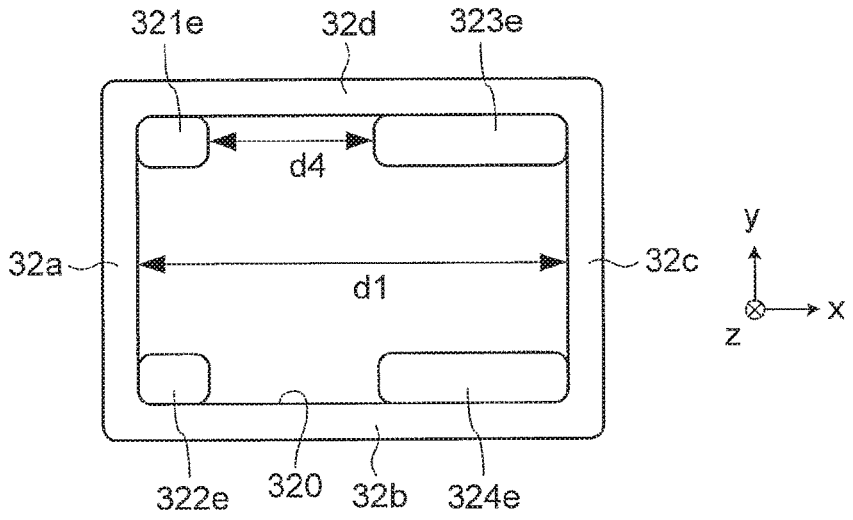
FIG. 8A is a bottom view (i.e., a view as seen in +Z direction) showing a configuration of a lid portion of Embodiment 2.
Figure 8B:
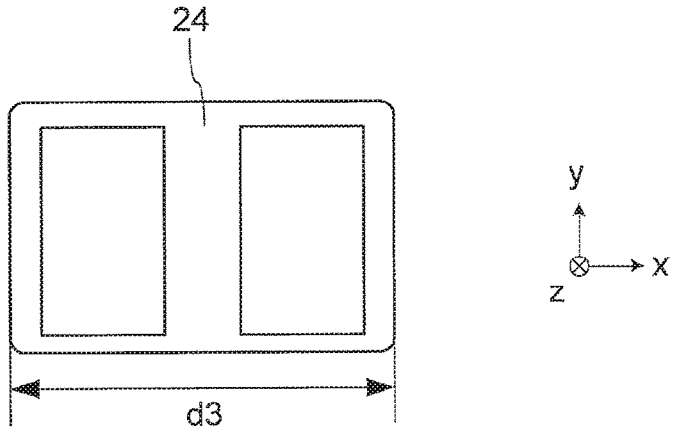
FIG. 8B is a bottom view (i.e., a view as seen in +Z direction) showing a configuration of a substrate member of Embodiment 2.
Figure 8C:
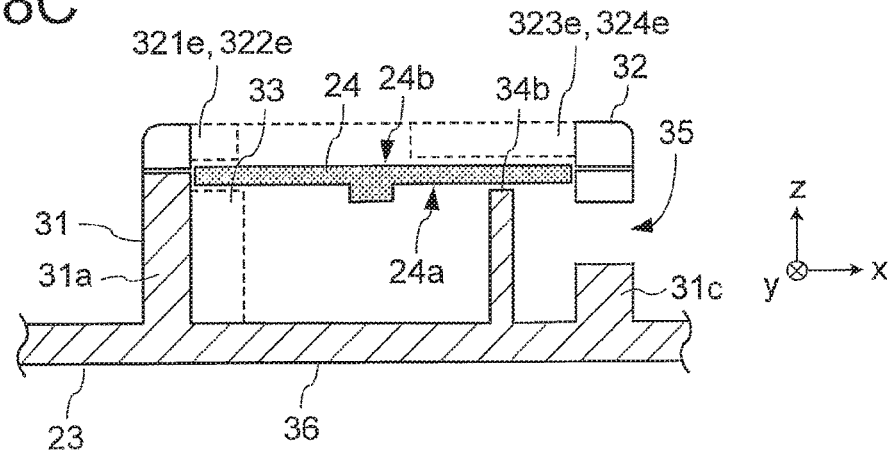
FIG. 8C is a sectional view showing a configuration of the substrate storage portion of Embodiment 2 (corresponding to a sectional view taken along line 5C-5C in FIG. 3)
Figure 9A:
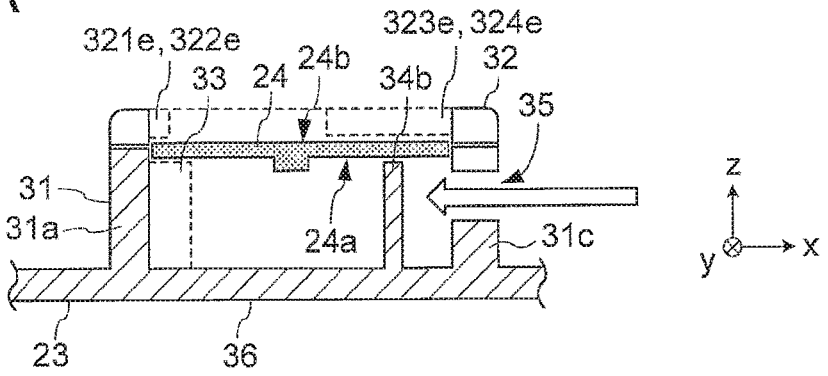
FIGS. 9A, 9B, 9C and 9D are schematic views showing a removing operation of the substrate member from the toner cartridge of Embodiment 2.
Figure 9B:
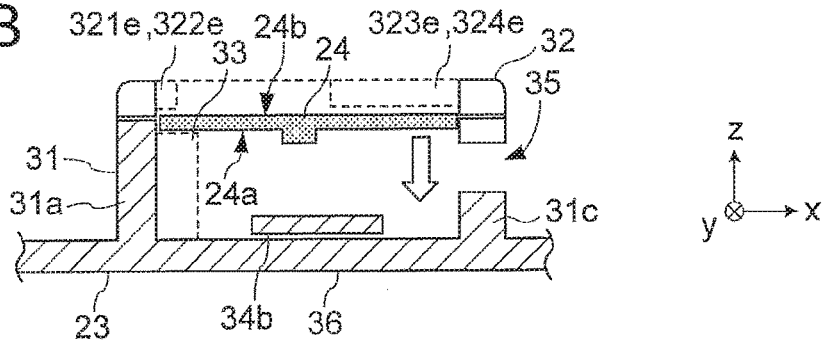
Figure 9C:
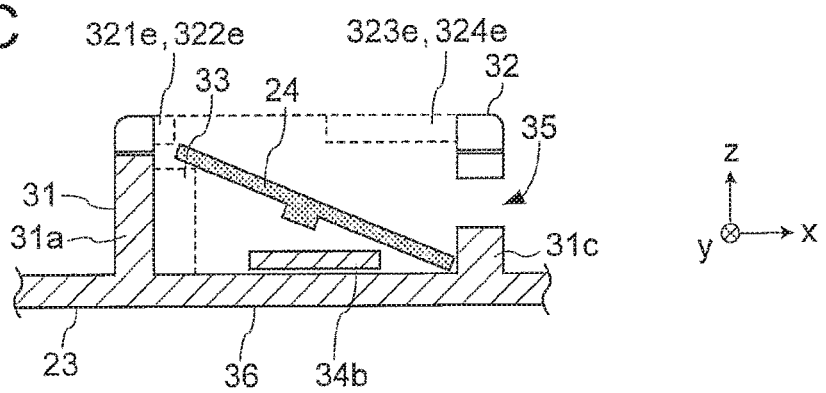
Figure 9D:
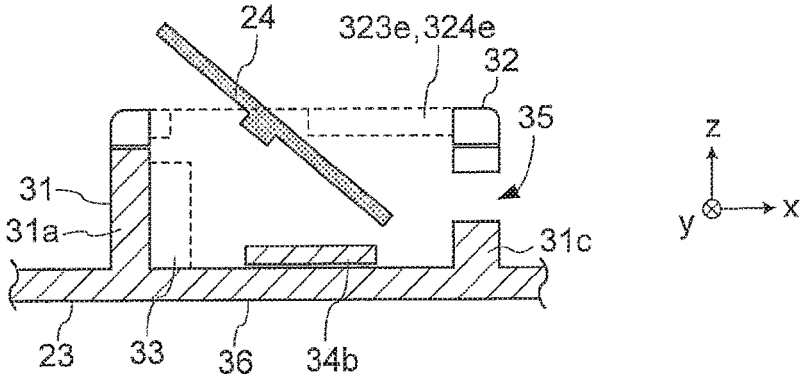

As shown in FIG. 7A, the second support portion 34*b* of Embodiment 2 has a rectangular parallelepiped shaped (i.e., a rib shape). Further, as shown in FIG. 8C, a connecting portion between the second support portion 34*b* and the bottom portion 36 of the substrate storage portion 30*a* of Embodiment 2 is sufficiently thin in the x axis direction. That is, the connecting portion can be easily broken without providing a thin-walled portion. Therefore, the thin-walled portion described in Embodiment 1 is not provided in Embodiment 2.

Figure 7C:
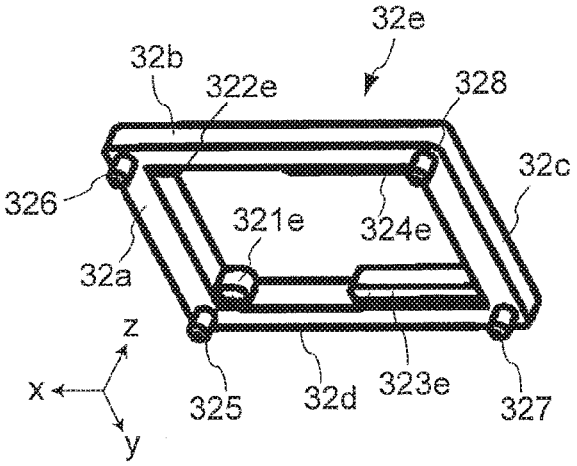
Figure 7D:
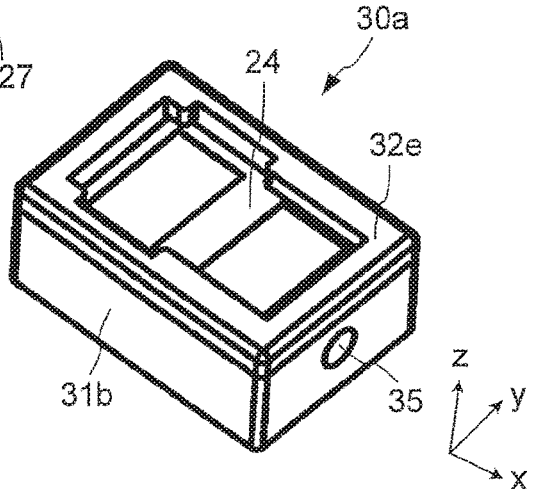

As shown in FIG. 7C and FIG. 8A, the protrusions 321*e*, 322*e*, 323*e* and 324*e* are formed on the side 32*b* and the side 32*d* of the lid portion 32*e* facing each other. The protrusions 322*e* and 324*e* protrude from the side 32*b* in +y direction. The protrusions 321*e* and 323*e* protrude from the side 32*d* in −y direction. As shown in FIG. 7C and FIG. 8A, each of the protrusions 323*e* and 324*e* has an elongated shape extending in the x axis direction.

As shown in FIGS. 8A and 8B, a length d3 of the substrate member 24 in the longitudinal direction (i.e., the x axis direction) is shorter than the length d1 of the opening 320 of the lid portion 32*e* in the longitudinal direction, and is longer than the distance d4 between the protrusion 321*e* and the protrusion 323*e* of the lid portion 32*e*. That is, the length d1, the length d3 and the distance d3 satisfy a relationship d1>d3>d4. With such a relationship (particularly d3>d4), when the substrate member 24 is stored in the substrate storage portion 30*a* and is fixed by the lid portion 32*e*, a movement of the substrate member 24 in the thickness direction (i.e., +z axis direction) is restricted by the protrusions 321*e*, 322*e*, 323*e* and 324*e* of the lid portion 32*e*. Therefore, the substrate member 24 is prevented from being removed from the substrate storage portion 30*a*.

According to the developer storage container (i.e., the toner cartridge 19) of Embodiment 2, the same effect as that of the developer storage container of Embodiment 1 can be obtained.

According to the developer storage container (i.e., the toner cartridge 19) of Embodiment 2, the second support portion 34*b* has a rectangular parallelepiped shape, and has a large surface facing the through-hole 35 of the outer surrounding wall 31. Therefore, the second support portion 34*b* can be easily broken by a tool or the like inserted through the through-hole 35 of the outer surrounding wall 31.

According to the developer storage container (i.e., the toner cartridge 19) of Embodiment 2, the connecting portion between the second support portion 34*b* and the bottom portion 36 of the substrate storage portion 30*a* is thin in the x axis direction. Therefore, the connecting portion can be easily broken without providing a thin-walled portion, and a manufacturing process can be simplified.

MODIFICATIONS

The present invention is not limited to the above-described embodiments, but modifications may be made without departing from the scope of the invention. For example, in the above described embodiments, the printer 100 is described as an example of the image forming apparatus. However, the present invention is also applicable to a copier, a facsimile machine, a MFP (Multi-Function Peripheral) having these functions, or the like. Further, the substrate support structure of the present invention is applicable to other apparatuses than the image forming apparatus.

FIGS. 10A through 10E are bottom views (i.e., views as seen in +z axis direction) showing positions and shapes of the first support portion 33 and the second support portion 34 of modifications. In the above described embodiments, the first support portion 33 is disposed besides the side 31*a* of the outer surrounding wall 31, and the second support portion 34 is disposed beside the side 31*c* of the outer surrounding wall 31. However, the positions and numbers of the first support portion 33 and the second support portion 34 are not limited to those shown in FIGS. 4A and 7A. The first support portion 33 and the second support portion 34 may be formed and disposed as shown in FIGS. 10A through 10E.

In each of FIGS. 10A through 10E, an arrow indicates a direction in which the substrate member 24 falls down. In the above described embodiment, the substrate member 24 falls down and is inclined in the x axis direction as shown in FIG. 6C. In other words, the substrate member 24 falls down in such a manner that the side (i.e., the shorter side) of the substrate member 24 extending in the y axis direction contacts the bottom portion 36 of the substrate storage portion 30. However, the substrate member 24 may fall down and be inclined in the Y axis direction. In other words, the substrate member 24 may fall down in such a manner the side (i.e., the longer side) of the substrate member 24 extending in the X direction may contact the bottom portion 36 of the substrate storage portion 30. For example, in configurations shown in FIGS. 10A, 10C and 10D, the substrate member 24 falls down and is inclined in the X axis direction. In configurations shown in FIGS. 10B and 10E, the substrate member 24 falls down and is inclined in the Y axis direction.

Figure 10A:
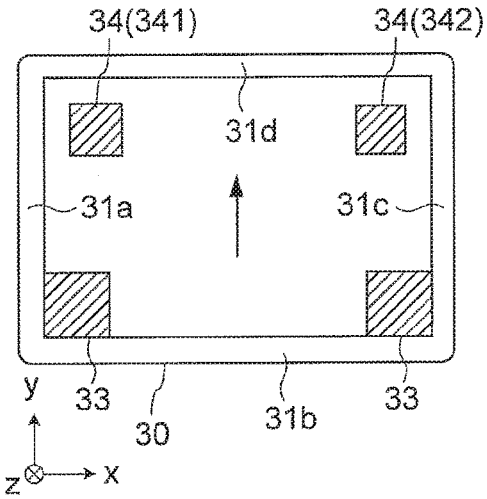
FIGS. 10A, 10B, 10C, 10D and 10E are bottom views (i.e., views as seen in +Z direction) showing examples of positions and shapes of a first support portion and a second support portion of modifications.
Figure 10D:
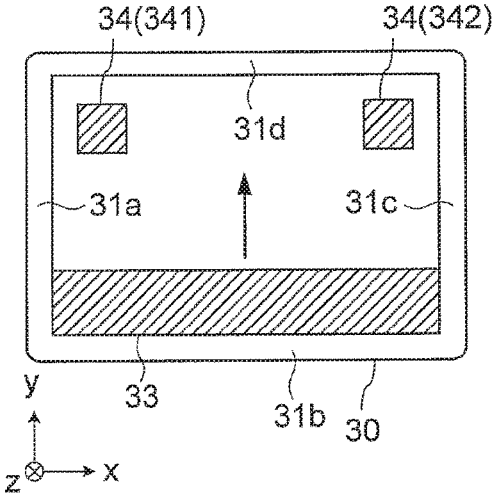
Figure 10B:
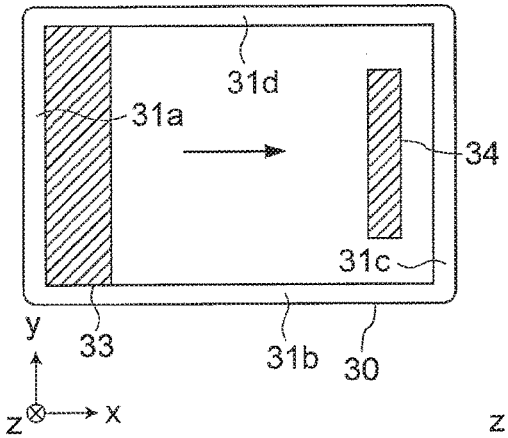
Figure 10E:
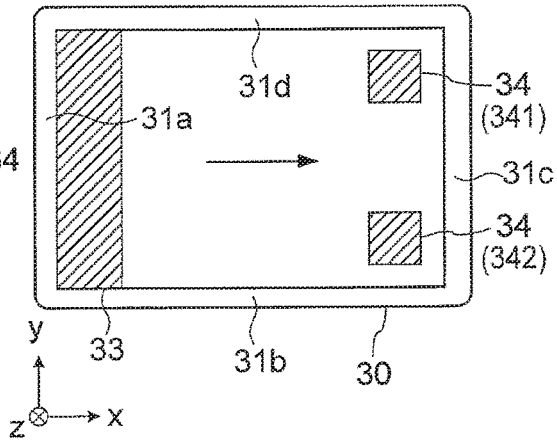
Figure 10C:
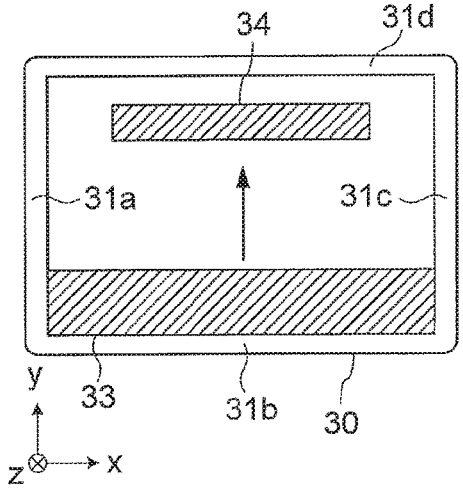

In the above described embodiments, the first support portion 33 and the second support portion 34 are disposed beside the sides 31*a* and 31*c* (i.e., shorter sides, or the first side and the second side) of the outer surrounding wall 31 (see FIG. 4A). However, the first support portion 33 and the second support portion 34 may be disposed beside the sides 31*b* and 31*d* (i.e., longer sides, or the third side and the four side) of the outer surrounding wall 31 as shown in FIGS. 10A, 10C and 10D.

In the above described embodiments, the second support portion 34 is configured as a single substrate support stand (see FIG. 4A). However, the second support portion 34 may be configured as two or more substrate support stands as shown in FIGS. 10A, 10D and 10E. In this case, the second support portion 34 may include a third substrate support 341 stand and a fourth substrate support stand 342 that support the substrate member 24 as shown in FIGS. 10A, 10D and 10E. The fourth substrate support stand 342 may be disposed at a distance from the third substrate support stand 341. In the case where the second support portion 34 is configured as two or more substrate support stands, the first support portion 33 may be configured as a single substrate support stand so as to obtain the three-point support structure as shown in FIGS. 10D and 10E. Further, both of the first support portion 33 and the second support portion 34 may be configured as single substrate supports as shown in FIGS. 10B and 10C.

Figure 11A:
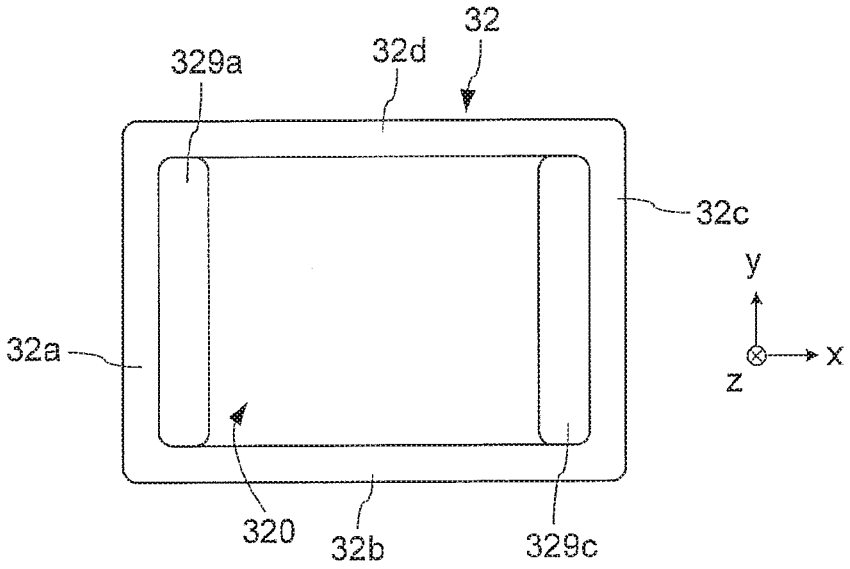
FIGS. 11A and 11B are bottom views (i.e., views as seen in +Z direction) showing configurations of lid portions of modifications.
Figure 11B:
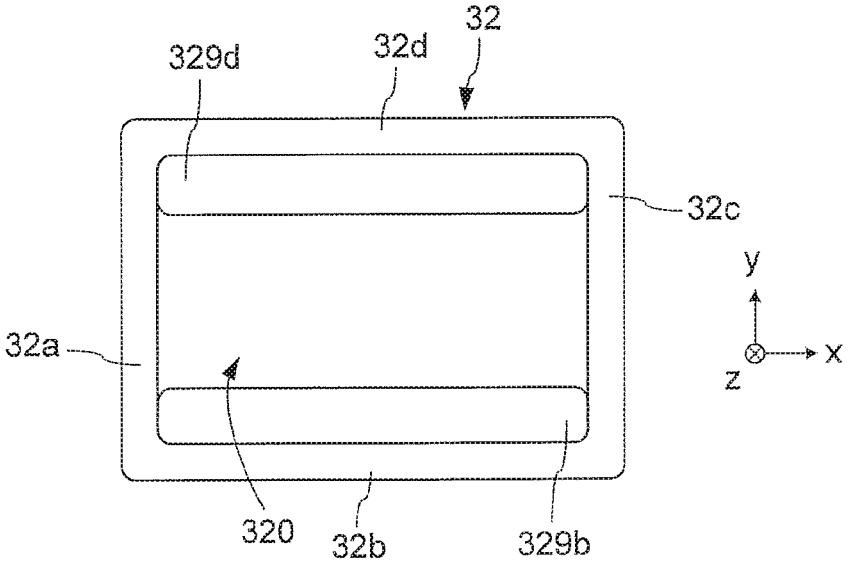

FIGS. 11A and 11B are bottom views (i.e., views as seen in +z axis direction) showing a configuration of the lid portion 32 of modifications. In the above described embodiments, the lid portion 32 have the protrusions 321, 322, 323 and 324 formed on four positions and protruding inwardly of the lid portion 32 (i.e., +x axis direction and −x axis direction) as shown in FIG. 5A. However, as shown in FIG. 11A, the lid portion 32 may have protrusions 329*a* and 329*c* formed on the sides 32*a* and 32*c* (i.e., shorter sides, or the fifth side and the sixth side) of the lid portion 32. Further, as shown in FIG. 11B, the lid portion 32 may have protrusions 329*b* and 329*d* formed on the sides 32*b* and 32*d* (i.e., longer sides, or the seventh side and the eighth side) of the lid portion 32.

The lid portion 32 shown in FIG. 11A and the lid portion 32 shown in FIG. 11B may be coupled with the substrate storage portion 30 (FIG. 4A) of Embodiment 1, the substrate storage portion 30*a* (FIG. 7A) of Embodiment 2, and the substrate storage portion 30 (FIGS. 10A through 10E) of the modifications.

While the preferred embodiments of the present invention have been illustrated in detail, it should be apparent that modifications and improvements may be made to the invention without departing from the spirit and scope of the invention as described in the following claims.

What is claimed is:

1. A developer storage container comprising:

a container wall;

a substrate member having a first surface and a second surface opposite to each other; and a storage portion provided on the container wall and storing the substrate member, wherein the storage portion comprises:

an outer surrounding wall provided on the container wall;

a first support portion disposed inside the outer surrounding wall, the first support portion supporting the first surface of the substrate member;

a second support portion disposed inside the outer surrounding wall and connected to the container wall, the second support portion supporting the first surface of the substrate member; and a lid portion fixed to the outer surrounding wall and having an opening through which the substrate member is exposed, the lid portion contacting the second surface of the substrate member, wherein the lid portion includes a first protrusion and a second protrusion protruding in a second direction perpendicular to a first direction from the substrate member to the container wall;

wherein a distance between the first protrusion and the second protrusion in the second direction is shorter than a length of the substrate member in the second direction; and wherein the outer surrounding wall has a through-hole disposed so as to face the second support portion.

2. The developer storage container according to claim 1, wherein a connecting portion between the second support portion and the container wall is thinner than a portion of the container wall around the connecting portion.

3. The developer storage container according to claim 1, wherein the outer surrounding wall has a rectangular shape as seen in the first direction;

wherein the outer surrounding wall has a first side and a second side opposing each other and defining shorter sides of the rectangular shape, and a third side and a fourth side opposing each other and defining longer sides of the rectangular shape;

wherein the lid portion has a rectangular shape as seen in the first direction;

wherein the lid portion has a fifth side and a sixth side opposing each other and defining shorter sides of the rectangular shape, and a seventh side and an eighth side opposing each other and defining longer sides of the rectangular shape.

4. The developer storage container according to claim 3, wherein the first support portion is disposed so as to face the first side of the outer surrounding wall;

wherein the second support portion is disposed so as to face the second side of the outer surrounding wall;

wherein the first protrusion is disposed so as to face the fifth side of the lid portion; and wherein the second protrusion is disposed so as to face the sixth side of the lid portion.

5. The developer storage container according to claim 3, wherein the first support portion is disposed so as to face the third side of the outer surrounding wall;

wherein the second support portion is disposed so as to face the fourth side of the outer surrounding wall;

wherein the first protrusion is disposed so as to face the fifth side of the lid portion; and wherein the second protrusion is disposed so as to face the sixth side of the lid portion.

6. The developer storage container according to claim 3, wherein the first support portion is disposed so as to face the first side of the outer surrounding wall;

wherein the second support portion is disposed so as to face the second side of the outer surrounding wall;

wherein the first protrusion is disposed so as to face the seventh side of the lid portion; and wherein the second protrusion is disposed so as to face the eighth side of the lid portion.

7. The developer storage container according to claim 3, wherein the first support portion is disposed so as to face the third side of the outer surrounding wall;

wherein the second support portion is disposed so as to face the fourth side of the outer surrounding wall;

wherein the first protrusion is disposed so as to face the seventh side of the lid portion; and wherein the second protrusion is disposed so as to face the eighth side of the lid portion.

8. The developer storage container according to claim 1, wherein at least one of a surface of the first protrusion contacting the substrate member and a surface of the second protrusion contacting the substrate member has an elongated shape as seen in the first direction.

9. The developer storage container according to claim 1, wherein the first support portion includes:

a first substrate support stand supporting the substrate member, and a second substrate support stand disposed apart from the first substrate support stand and supporting the substrate member.

10. The developer storage container according to claim 1, wherein the second support portion includes:

a third substrate support stand supporting the substrate member, and a fourth substrate support stand disposed apart from the third substrate support stand and supporting the substrate member.

11. The developer storage container according to claim 1, wherein the second support portion has a cylindrical shape.

12. The developer storage container according to claim 1, wherein the second support portion has a rectangular parallelepiped shape.

13. The developer storage container according to claim 1, wherein the lid portion has a third protrusion protruding in the first direction, wherein the outer surrounding wall has an insertion hole into which the third protrusion of the lid portion is inserted.

14. A developing device comprising:

the developer storage container according to claim 1, and a developer bearing body that develops a latent image on an image bearing body using a developer supplied by the developer storage container.

15. An image forming apparatus comprising:

an image bearing body;

a latent image forming device that forms a latent image on the image bearing body; and the developer storage container according to claim 1, and a developer bearing body that develops the latent image on the image bearing body using the developer supplied by the developer storage container.

16. A substrate support structure comprising:

a substrate member having a first surface and a second surface opposite to each other; and a storage portion storing the substrate member, wherein the storage portion comprises:

a bottom portion;

an outer surrounding wall provided on the bottom portion and surrounding an outer circumference of the substrate member;

a first support portion disposed inside the outer surrounding wall and supporting the first surface of the substrate member;

a second support portion disposed inside the outer surrounding wall and supporting the first surface of the substrate member; and a lid portion fixed to the outer surrounding wall and having an opening through which the substrate member is exposed, the lid portion contacting the second surface of the substrate member, wherein the lid portion includes a first protrusion and a second protrusion protruding in a second direction perpendicular to a first direction from the substrate member to the bottom portion;

wherein a distance between the first protrusion and the second protrusion in the second direction is shorter than a length of the substrate member in the second direction; and wherein the outer surrounding wall has a through-hole disposed so as to face the second support portion.

* * * * *